US006404450B1

(12) United States Patent
Fukaya

(10) Patent No.: US 6,404,450 B1
(45) Date of Patent: Jun. 11, 2002

(54) PICTURE IMAGE FORMING SYSTEM WITH TEST FUNCTION AND PICTURE IMAGE FORMING METHOD

(75) Inventor: Hideaki Fukaya, Chiba (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/678,495

(22) Filed: Oct. 4, 2000

(51) Int. Cl.[7] ..... G03G 15/01
(52) U.S. Cl. ..... 347/116; 399/301
(58) Field of Search ..... 347/116; 399/299, 399/301, 72

(56) References Cited

FOREIGN PATENT DOCUMENTS

| | | | |
|---|---|---|---|
| JP | 2-59772 | * | 2/1990 |
| JP | 8-69146 | | 3/1996 |
| JP | 8-286457 | * | 11/1996 |
| JP | 10-260567 | | 9/1998 |

* cited by examiner

*Primary Examiner*—Joan Pendegrass
(74) *Attorney, Agent, or Firm*—Foley & Lardner

(57) ABSTRACT

There is provided a picture image forming system comprising: a plurality of picture image forming parts for forming a picture images in accordance with a picture signals; test pattern forming means for causing the plurality of picture image forming parts to form test patterns which are used for correcting the deviations in position of picture images formed by the plurality of picture image forming parts; detecting means for detecting the widths of the test patterns formed by the plurality of picture image forming parts; and changing means for comparing the widths of the test patterns read by the detecting means, with a predetermined reference widths to change the widths of the test patterns on the basis of the compared results.

19 Claims, 7 Drawing Sheets

PICTURE IMAGE FORMING SYSTEM WITH TEST FUNCTION AND PICTURE IMAGE FORMING METHOD

BACKGROUND OF THE INVENTION

1. Field of the Invention

The present invention relates generally to a picture image forming system and a picture image forming method.

2. Related Background Art

Color picture image forming systems mainly use tandem systems for sequentially superposing and transferring images to obtain a color picture image by means of a plurality of picture image forming parts. Among such tandem systems, primarily used is a "train-of-four" tandem system for superposing four colors (yellow, magenta, cyanogen and black).

Color picture image forming systems which utilize tandem systems offer the advantage of high printing speed. However, it is difficult to align the picture images in the respective colors, as a result, the positions of the aligned picture images in the colors are sometimes shifted to fade or blur characters and images, and the picture quality of the obtained color picture image is deteriorated. Therefore, in order to prevent the aligned picture images in the colors from being shifted, there is generally known a method for forming a test pattern, which is used for correcting the deviation in position of picture images formed by a plurality of picture image forming parts, on a conveying belt to detect the test pattern by a test pattern position detecting sensor to correct the deviation in position. According to this method, it is possible to precisely correct the deviation in position if the test pattern is normally formed.

However, in this method, there is a problem in that there are some cases where the width of the test pattern formed on the conveying belt is not normal due to environmental variation, deterioration with age and deterioration in consumable supplies when a picture quality maintaining control (a control for printing at an appropriate density) is not carried out, so that it is not possible to sufficiently precisely correct the deviation in position. Examples for explaining this problem are shown in FIGS. 7(*a*) through 7(*c*). In FIGS. 7(*a*) through 7(*c*), reference number 7 denotes a conveyor belt, and 9 denotes a toner for a test pattern. FIG. 7(*a*) shows an example where the width of the pattern is too narrow, FIG. 7(*b*) shows an example where the width of the pattern is too wide, and FIG. 7(*c*) shows an example where the width of the pattern is normal. For example, in general, the toner is difficult to adhere to the conveyor belt when conditions of low temperature and humidity exist as shown in FIG. 7(*a*), and excessive toner adheres to the conveyor belt under conditions of high temperature and humidity as shown in FIG. 7(*b*). If the test pattern is thus not normal, it is not possible to precisely detect the test pattern for each color, so that it is not possible to normally correct the deviation in position.

This will be described in more detail below. FIG. 8 shows an example of a detection signal indicative of the width of a test pattern. The test pattern position detecting sensor is designed to optically detect the presence of the pattern to output an analog signal indicative of the detected result. This analog signal is converted into a binary level digital signal based on an appropriate threshold as shown in FIG. 8. In FIG. 8, the width of the test pattern is detected by digital signals of H and L levels so that the test pattern exists at L level and no test pattern exists at H level. In FIG. 8, two test patterns having a pattern width of w are detected. For example, if the conditions for forming the picture image of the test pattern are varied due to the variation in environment, such as the conditions of low temperature and humidity, it is not possible to recognize the test pattern at a certain boundary value. Therefore, the width w of the test pattern is erroneously detected, so that it is not possible to normally correct the deviation in position.

As a method for solving this problem, Japanese Patent Laid-Open No. 10-260567 discloses a method for changing the conditions for forming the picture image of a test pattern in accordance with a value which is outputted from a density detecting sensor provided for detecting the density of the test pattern. This method intends to improve the precision of the correction of the deviation in position by maintaining the fact that the density of the test pattern detected by the test pattern position detecting sensor is always constant. However, this method can not sufficiently improve the precision of the correction of the deviation in position. That is, although this method can sufficiently improve the precision of the correction of the deviation in position if it can be assumed that the width of the test pattern is appropriate when the density of the test pattern is appropriate, the density and width of the pattern are, in fact, not always be coincident with each other, so that it is not possible to sufficiently improve the precision of the correction of the deviation in position.

SUMMARY OF THE INVENTION

It is therefore an object of the present invention to eliminate the aforementioned problems and to provide a picture image forming system capable of obtaining a high picture quality by precisely correcting the deviation in position of picture images formed by a plurality of picture image forming parts.

In order to accomplish the aforementioned and other objects, according to one aspect of the present invention, there is provided a picture image forming system comprising: a plurality of picture image forming parts for forming picture images in accordance with a picture signals; test pattern forming means for causing the plurality of picture image forming parts to form test patterns which are used for correcting the deviations in position of a picture image formed by the plurality of picture image forming parts; detecting means for detecting the widths of the test patterns formed by the plurality of picture image forming parts; and changing means for comparing the widths of the test patterns read by the detecting means, with a predetermined reference widths to change the width of the test pattern on the basis of the compared results.

According to another aspect of the present invention, there is provided a picture image forming method for forming a picture image by superposing picture images on a recording medium using a plurality of picture image forming parts for forming the picture images in accordance with picture signals, the method comprising the steps of :causing the plurality of picture image forming parts to form test patterns which are used for correcting the deviation in position of a corresponding one of the picture images formed by the plurality of picture image forming parts; detecting the widths of the test patterns formed by the plurality of picture image forming parts; determining each the detected width of the test pattern within a predetermined reference width range; and correcting the deviations in position of the corresponding the picture images, which have been formed by the plurality of picture image forming parts, on the detected results for the test patterns when the widths of the test patterns are within the predetermined reference width ranges.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of the present invention are described below.

Figure 1:
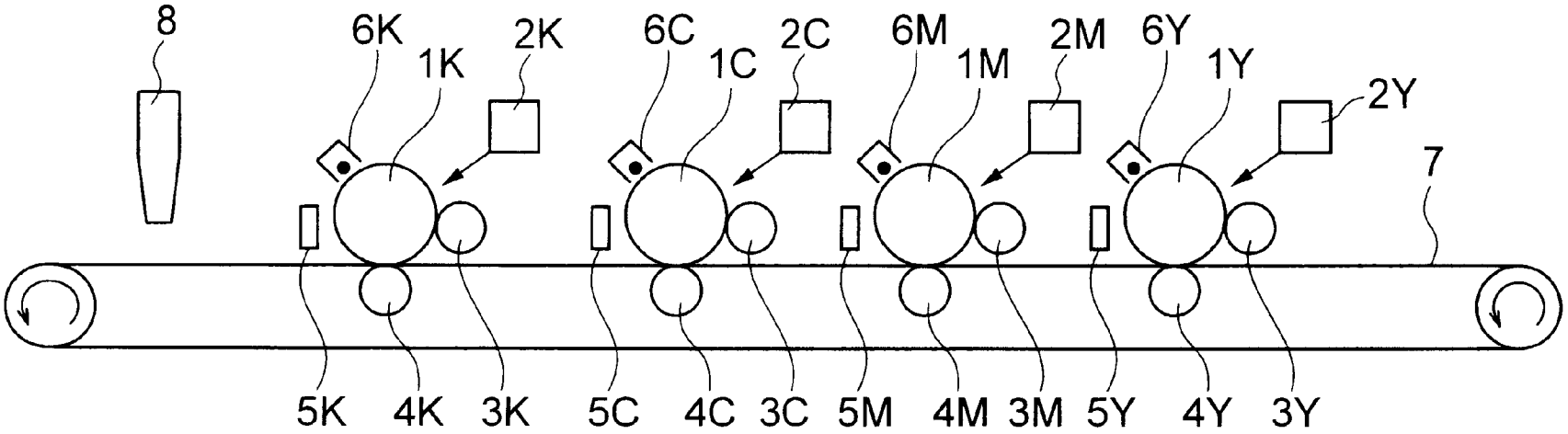
FIG. 1 is a side view showing the first and second preferred embodiments of a picture image forming system according to the present invention.

FIG. 1 is a side view of a preferred embodiment of a picture image forming system according to the present invention. In the figure, reference number 1 denotes a photosensitive drum, 2 denotes an exposure device, 3 denotes a developing device, 4 denotes a transfer roller, 5 denotes a de-electrifier, and 6 denotes an electrification charger. These parts constitute a picture image forming part. This picture image forming part carries out electrification, exposure, development and transfer in accordance with picture signals to form a picture image. In the figure, Y denotes yellow, M denotes magenta, C denotes cyanogen, and K denotes black. For example, 1Y denotes a yellow photosensitive drum, 1M denotes a magenta photosensitive drum, IC denotes a cyanogen photosensitive drum, and 1K denotes a black photosensitive drum. Reference number 7 denotes a conveyor belt serving as a conveying means for conveying a recording medium. The picture image forming system in this preferred embodiment is a color picture image forming system of a train-of-four tandem system for superposing four colors by arranging four picture image forming parts corresponding to yellow Y, magenta M, cyanogen C and black K in horizontal directions and conveying a paper serving as a recording medium on the conveyor belt 7.

The picture image forming system in this preferred embodiment has a test pattern forming means for forming a test pattern, which is used for correcting the deviation in position of a picture image in the picture image forming part. That is, a control circuit transmits picture signals to the picture image forming parts 1 through 6, and the picture image forming parts form a test pattern, which is used for correcting the deviation in position of a picture image on the basis of the picture signals. In this preferred embodiment, the test pattern is formed on the conveyor belt.

In FIG. 1, reference number 8 denotes a test pattern position detecting sensor for detecting the position of the above described test pattern. On the basis of this information, the deviation in position of the picture image formed by each of the picture image forming parts is detected. This is calculated by a microcomputer of the control circuit.

The picture image forming system in this preferred embodiment has a test pattern detecting means for detecting the width of the test pattern formed by the picture image forming part, and a changing means for comparing the width of the test pattern, which has been read by the test pattern detecting means, with a predetermined reference width to change the width of the test pattern on the basis of the compared result. That is, the CPU of the control circuit compares the width of the test pattern, which has been read by a test pattern width detecting sensor for detecting the width of a test pattern, with a predetermined reference width which has been set in a nonvolatile memory. On the basis of the compared result, the control circuit changes the picture image forming conditions to transmit a new picture signal to the picture image forming part. The control circuit has a test pattern storing means for storing therein a plurality of test patterns having different widths, and selects one of the stored test patterns to transmit a signal indicative thereof to he picture image forming part to change the test pattern. The picture image forming part changes the width of the pattern in accordance with the changed picture image forming conditions, and forms a test pattern again.

Thus, the picture image forming system in this preferred embodiment has a test pattern width changing means, so that is t possible to optimize the width of the test pattern before the position of the test pattern for correcting the deviation in position is detected.

Two preferred embodiments using different test patterns are described below.

(First Preferred Embodiment)

The first preferred embodiment of a picture image forming system according to the present invention is characterized in that a single test pattern having the same width is formed for each color and that a process for optimizing the width of the pattern is carried out in a closed loop (feedback control).

Figure 2:
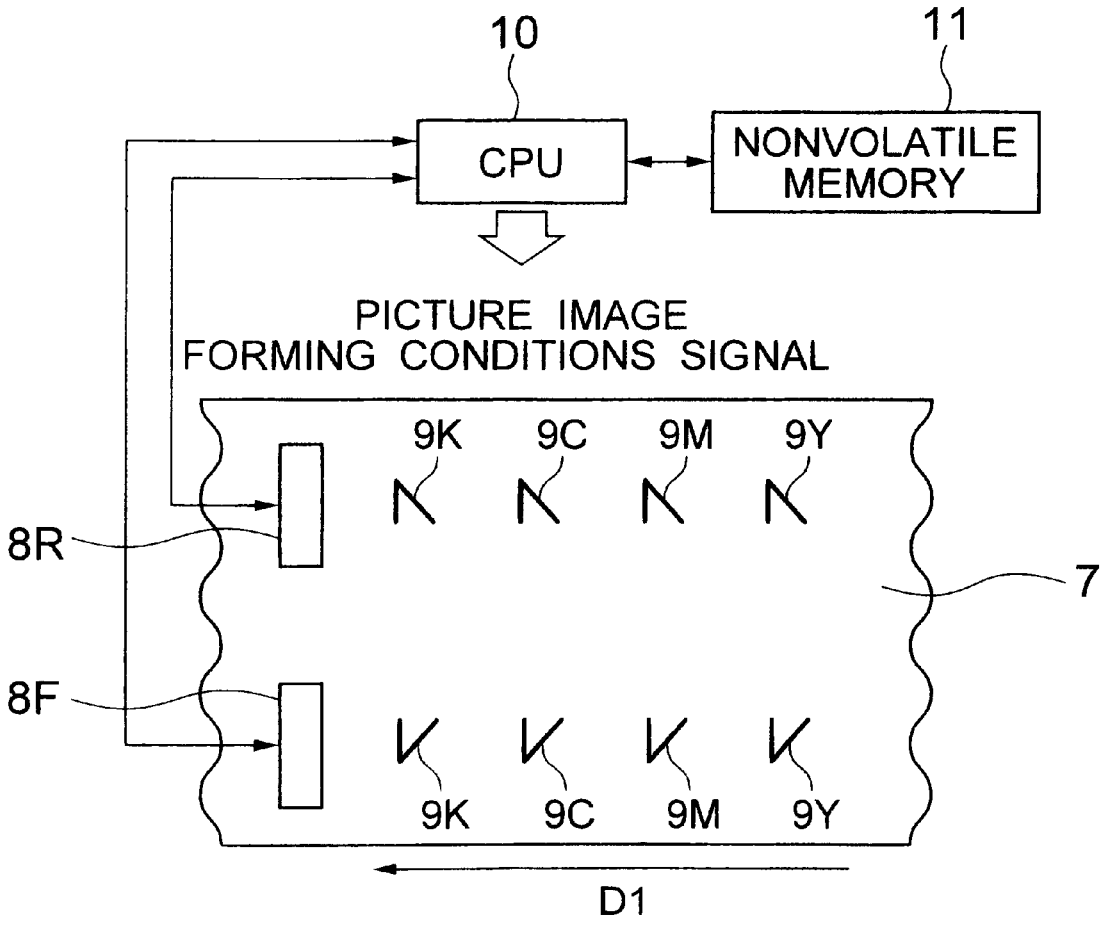
FIG. 2 is a schematic diagram showing a method for making a test pattern appropriate in the first preferred embodiment of a picture image forming system according to the present invention.
Figure 3:
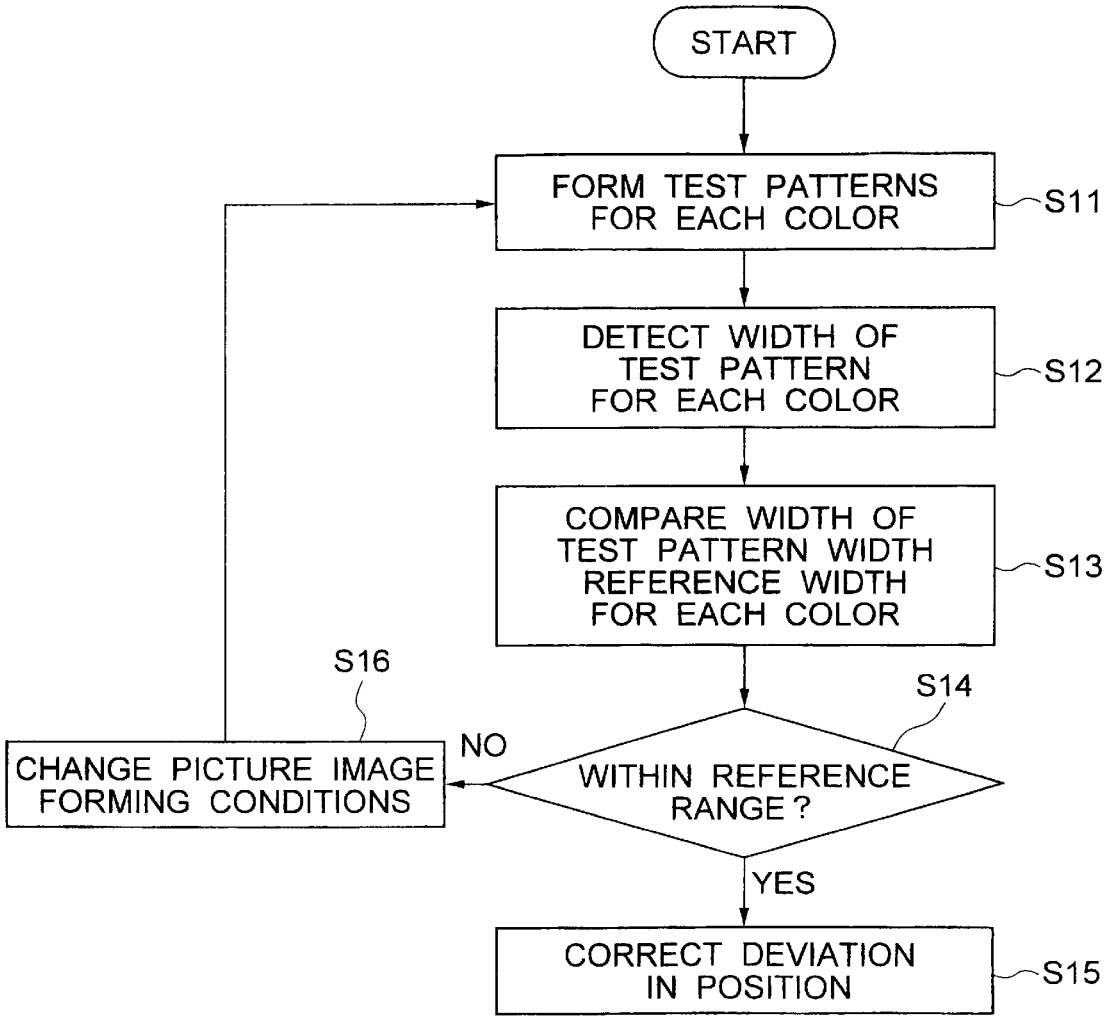
FIG. 3 is a flow chart for explaining a method for making a test pattern appropriate in the first preferred embodiment of a picture image forming system according to the present invention.

Referring to FIGS. 2 and 3, a method for correcting the deviation in position in the first preferred embodiment of a picture image forming system according to the present invention is schematically described below.

(1) First, the control circuit sets picture image forming conditions, and transmits picture signals to the picture image forming parts. The picture image forming parts form test patterns 9Y, 9M, 9C and 9K, which are used for correcting the deviation in position of a picture image, on the conveyor belt 7 in accordance with the picture signals, respectively (S11). Each of the test patterns is formed for each color, and has the same width and a linear portion.

(2) Then, a rear-side test pattern width detecting sensor 8R and a front-side test pattern width detecting sensor 8F detect the width of the linear portion of each of the test patterns in a conveying direction D1 of the conveyor belt, and transmit pattern width indicative signals to the control circuit (S12).

(3) Then, the CPU 10 of the control circuit compares the width of the pattern, which has been detected by the test pattern width detecting sensors, with a predetermined reference width which has been previously set in a nonvolatile memory 11 (S13).

(4) Then, the control circuit determines whether the detected pattern width is within a predetermined reference width range.

If the pattern width for a certain color is outside the reference width range, the control circuit changes the picture image forming conditions for the color, and transmits a new picture signal to the corresponding picture image forming part to cause the picture image forming part to again form a test pattern according to the changed picture image forming conditions (S16, S11). At this time, the picture image forming conditions for colors, for which test patterns having a test pattern within the reference range have been formed, are not changed. Then, if all of the test pattern widths for four colors become within the reference range, a positional deviation correction start signal is outputted.

When all of the pattern widths for four colors are within the reference range, the positional deviation correction start signal is immediately outputted.

Figure 4:
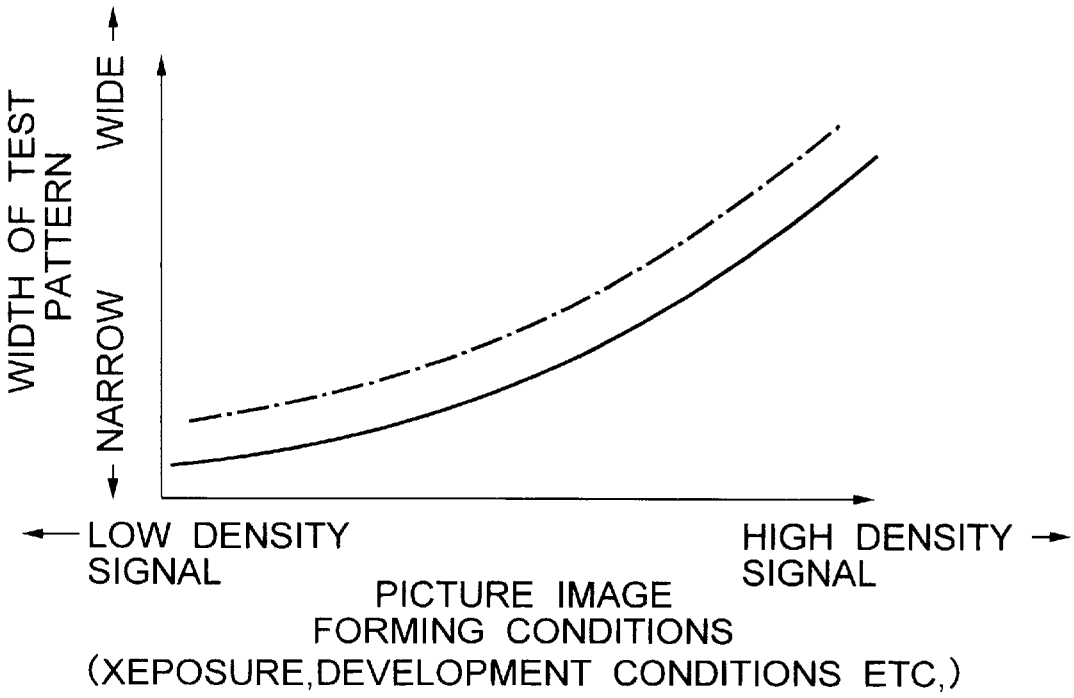
FIG. 4 is a graph for explaining a method for making a test pattern appropriate in the first preferred embodiment of a picture image forming system according to the present invention.

FIG. 4 shows an example where picture image forming conditions are changed to optimize the width of a test pattern. In the figure, solid and dashed lines show the test pattern widths in view of environmental variation, etc. Usually, if picture image forming conditions, such as exposure and development conditions, are high density signals, the test pattern width is wide, whereas if the conditions are low density signals, the test pattern width is narrow. In addition, for example, the test pattern width is thick when conditions of high temperature and humidity exist, as shown by the dashed line, and the test pattern width is thin when conditions of low temperature and humidity exist, as shown by the solid line.

(5) Then, after the positional deviation correction start signal is outputted from the control circuit, the deviation in position is corrected (S15). That is, the position of the test pattern is detected by the test pattern position detecting sensor, and the deviation in position of a picture image formed by each of the picture image forming parts is detected. The detected deviation is computed by the microcomputer of the control circuit to correct the deviation in position. After the correction of the deviation in position is completed, the test pattern on the conveyor belt is scraped by a cleaning blade.

According to the above described picture image forming system in this preferred embodiment, the width of the test pattern is optimized before the correction of the deviation in position is started, so that it is possible to improve the precision of the correction of the deviation in position to improve the picture quality.

On the other hand, according to conventional picture image forming systems, since the width of the test pattern is not optimized, the precision of the correction of the deviation in position is insufficient, resulting in a deterioration of the picture quality.

(Second Preferred Embodiment)

The second preferred embodiment of a picture image forming system according to the present invention is characterized in that a plurality of test patterns having different widths are formed for each color and that a test pattern optimizing process is basically carried out in an open loop.

Although the basic structure of the picture image forming system in this preferred embodiment is the same as that of the system in the first preferred embodiment, a method for forming a test pattern is different from that in the first preferred embodiment.

Figure 5:
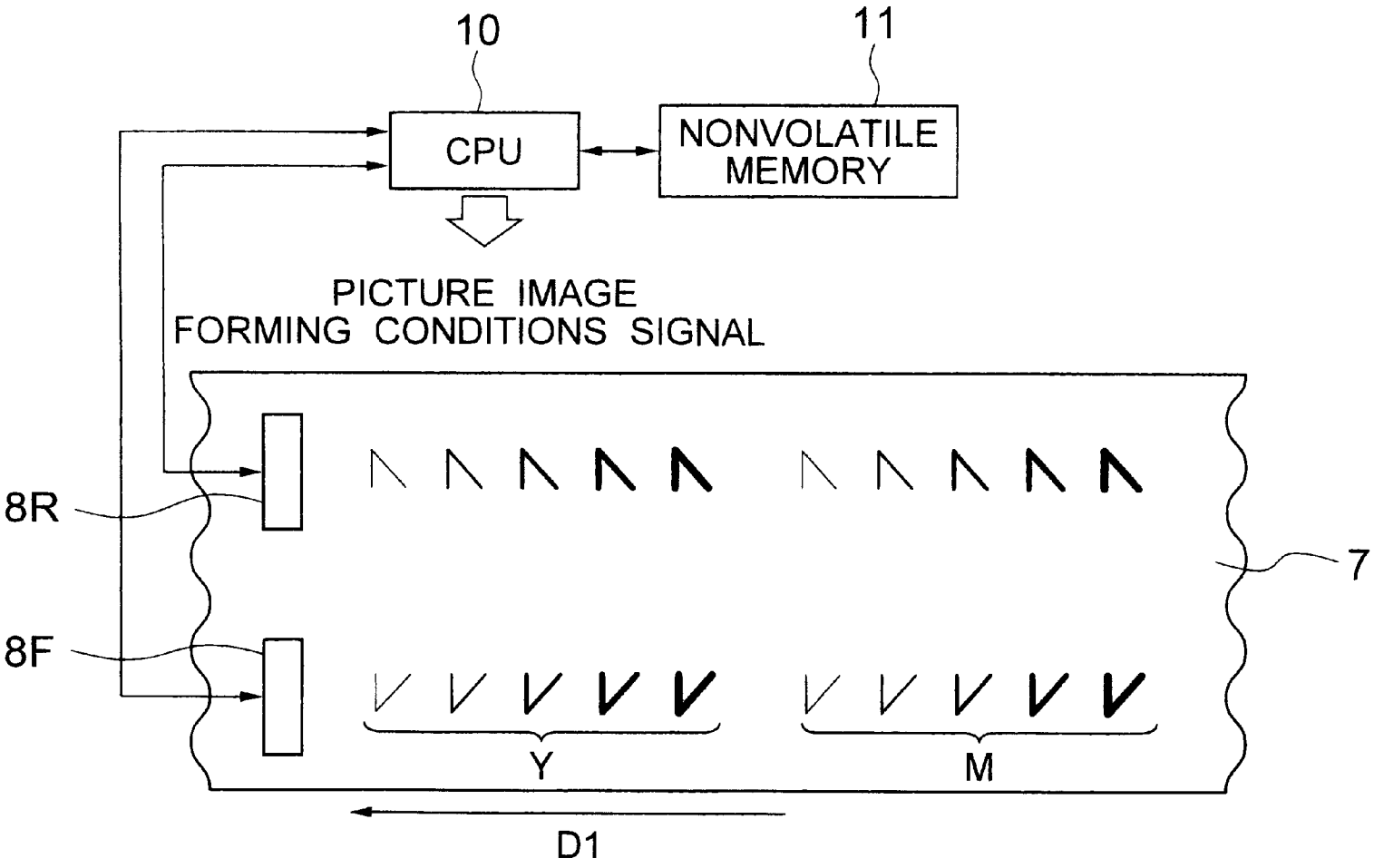
FIG. 5 is a schematic diagram showing a method for making a test pattern appropriate in the second preferred embodiment of a picture image forming system according to the present invention.
Figure 6:
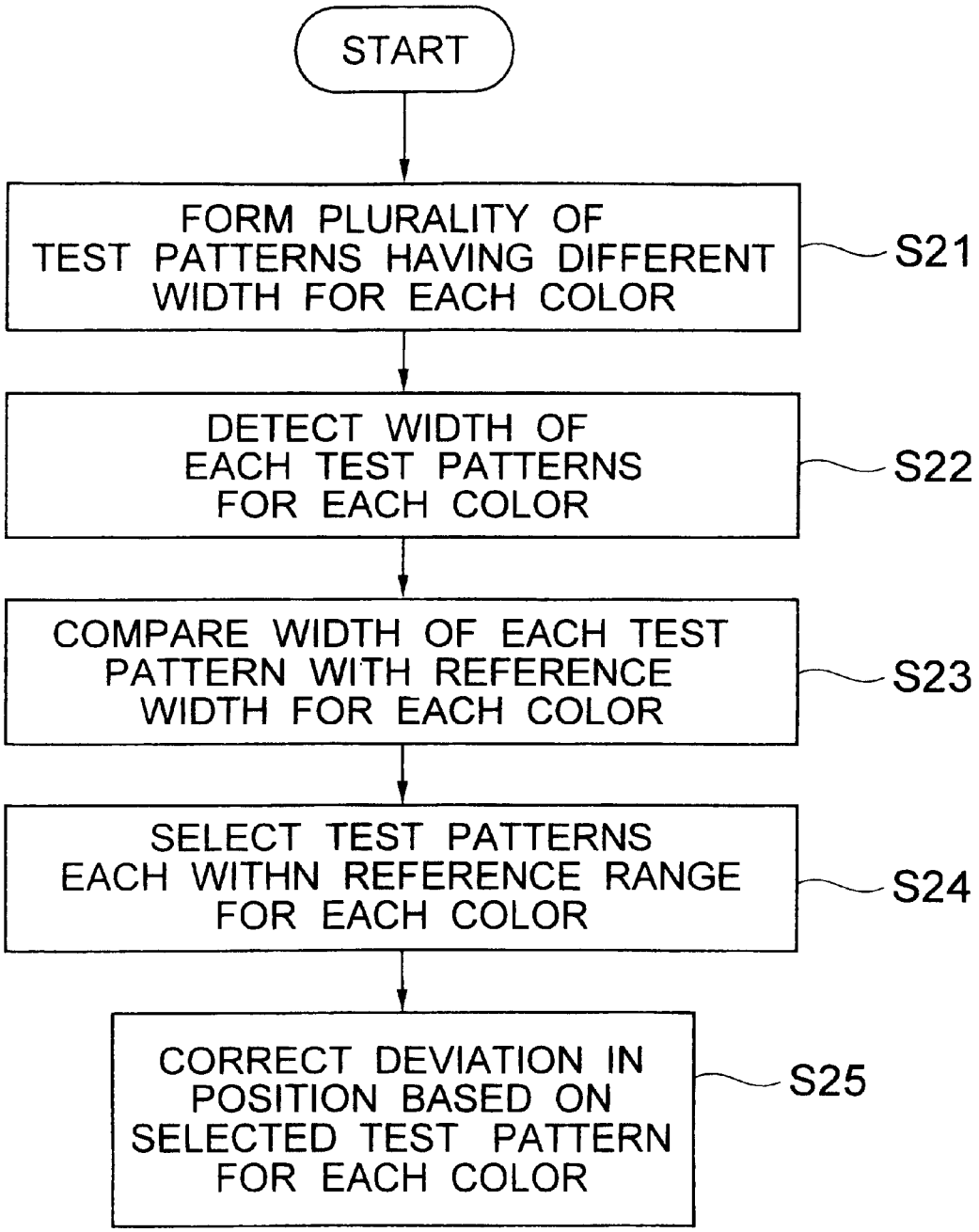
FIG. 6 is a flow chart for explaining a method for making a test pattern appropriate in the second preferred embodiment of a picture image forming system according to the present inventions
Figure 7:
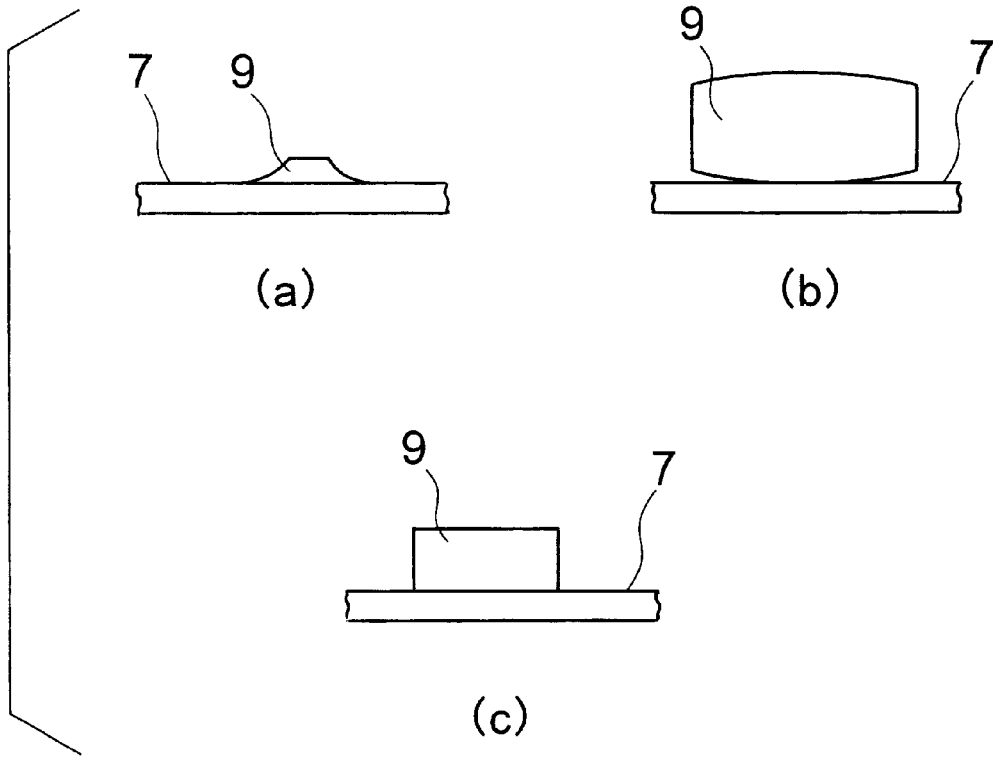
FIG. 7 is an enlarged sectional view of a toner adhering portion of a conveying belt in a conventional picture image forming system.
Figure 8:
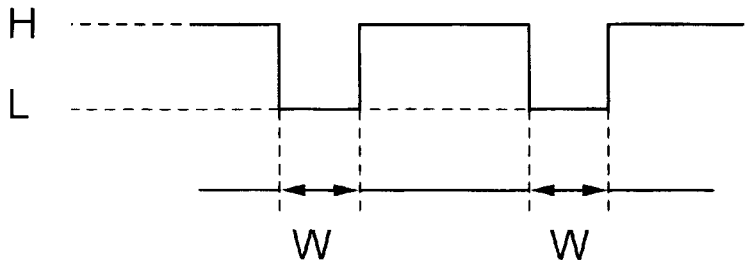
FIG. 8 is a chart showing a detection signal of a test pattern position detecting sensor in a conventional picture image forming system.

Referring to FIGS. 5 and 6, a method for correcting the deviation in position in the second preferred embodiment of a picture image forming system according to the present invention is briefly described below.

(1) First, the control circuit sets picture image forming conditions, and transmits picture signals to the picture image forming parts. Each of the picture image forming parts forms a plurality of test patterns, which have low to high densities for each color, on the conveying belt 7 in accordance with the picture signals. In FIG. 5, five kinds of test patterns having linear portions with respect to yellow Y and magenta M are shown (S21).

(2) Then, a rear-side test pattern width detecting sensor 8R and a front-side test pattern width detecting sensor 8F detect the width of the linear portion of each of the test patterns for each color in a conveying direction D1 of the conveyor belt, and transmit pattern width indicative signals to the control circuit (S22).

(3) Then, the CPU 10 of the control circuit compares the width of the pattern, which has been read by the test pattern width detecting sensors, with a predetermined reference width which has been previously set in a nonvolatile memory 11 (S23).

(4) Then, the control circuit determines whether the detected pattern width is within a predetermined reference width range, and selects a test pattern having a pattern width within the reference width range to use the selected test pattern in the following correction operation (S24). If all of the pattern widths for a certain color are outside the reference width range, the control circuit changes the picture image forming conditions for the color, and have the picture image forming part forming test patterns again (5) Then, the deviation in position is corrected (S25). That is, the position of the test pattern is detected by the test pattern position detecting sensor, and the deviation in position of a picture image formed by each of the picture image forming parts is detected. The detected deviation is computed by the microcomputer of the control circuit to correct the deviation in position. After the correction of the deviation in position is completed, the test pattern on the conveying belt is scraped by a cleaning blade.

In the above described second preferred embodiment of a method for correcting the deviation in position according to the present invention, the formation of the test patterns for each color may be carried out four times, or all of the test patterns for four colors may be formed at a time. Alternatively, the formation of the test patterns for two colors may be carried out twice.

According to the above-described picture image forming system in this preferred embodiment, the width of the test pattern is optimized before the correction of the deviation in position is started, so that it is possible to improve the precision of the correction of the deviation in position to improve the picture quality.

On the other hand, according to conventional picture image forming systems, since the width of the test pattern is not optimized, the precision of the correction of the deviation in position is insufficient, resulting in deterioration of the picture quality.

While the above-described preferred embodiments disclose only the case where four colors are used in the train-of-four tandem system, the same effects can be obtained even if only two or three colors are used according to the present invention. The present invention should not be limited to application to the train-of-four tandem system, but the invention may be generally applied to any picture image forming systems which have picture image forming parts for a plurality of colors and which correct the deviation in position of a picture image formed by the picture image forming parts.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A picture image forming system comprising:

a plurality of picture image forming parts for forming picture images in accordance with a picture signals;

test pattern forming means for causing said plurality of picture image forming parts to form test patterns which are used for correcting the deviations in position of picture images formed by said plurality of picture image forming parts;

detecting means for detecting the widths of said test patterns formed by said plurality of picture image forming parts; and changing means for comparing the widths of said test patterns read by said detecting means, with predetermined reference widths to change the widths of said test patterns on the basis of the compared results.

2. A picture image forming system as set forth in claim 1, wherein each of said test pattern has a linear portion, and said detecting means detects each of the width of said linear portions.

3. A picture image forming system as set forth in claim 1, wherein said test pattern forming means has test pattern storing means for storing therein predetermined test patterns.

4. A picture image forming system as set forth in claim 1, wherein said test pattern forming means has test pattern storing means for storing therein a plurality of test patterns having different widths, and changing means changes the width of said test pattern by selecting one of said plurality of test patterns stored in said test pattern storing means.

5. A picture image forming system as set forth in claim 1, wherein said changing means changes the width of said test pattern by changing picture image forming conditions of said picture image forming means.

6. A picture image forming system as set forth in claim 1, wherein said picture image forming system further comprises conveying means for conveying a recording medium, said conveying means being provided in said plurality of picture image forming parts.

7. A picture image forming system as set forth in claim 6, wherein said plurality of picture image forming parts form test patterns on said conveying means.

8. A picture image forming system as set forth in claim 7, wherein each of said plurality of picture image forming parts forms test patterns having the same width on said conveying means.

9. A picture image forming system as set forth in claim 7, wherein each of said plurality of picture image forming parts forms a plurality of test patterns having different width on said conveying means.

10. A picture image forming system as set forth in claim 1, which further comprises correcting means for correcting the deviations in position of a picture images, which are formed by said plurality of picture image forming parts, on the basis of the detected results for said test patterns.

11. A picture image forming method for forming a picture image by superposing picture images on a recording medium using a plurality of picture image forming parts for forming said picture images in accordance with picture signals, said method comprising the steps of:

causing said plurality of picture image forming parts to form test patterns which are used for correcting the deviation in position of a corresponding one of said picture images formed by said plurality of picture image forming parts;

detecting the widths of said test patterns formed by said plurality of picture image forming parts;

determining each said detected width of said test pattern within a predetermined reference width range;

correcting the deviations in position of said corresponding said picture images, which have been formed by said plurality of picture image forming parts, on the detected results for said test patterns when said widths of said test patterns are within said predetermined reference width ranges, and changing the widths of said test patterns when each width of said test pattern is not within a predetermined width range.

12. A picture image forming method as set forth in claim 11, wherein said each of test patterns has a linear portion, and the width of said linear portion is detected at said detecting step.

13. A picture image forming method as set forth in claim 11, wherein said each pattern forming step reads test patterns out of test pattern storing means stored predetermined test patterns.

14. A picture image forming method as set forth in claim 11, wherein the width of said test pattern is changed by changing picture image forming conditions of said picture image forming means when each width of said test pattern is not within a predetermined width range.

15. A picture image forming method as set forth in claim 11, wherein the width of said test pattern is changed by selecting one of a plurality of test patterns having a predetermined width, which are stored in storing means, when the width of said test pattern is not within a predetermined width range.

16. A picture image forming method as set forth in claim 11, wherein said plurality of picture image forming parts form test patterns on conveying means for conveying a recording medium to said plurality of picture image forming parts.

17. A picture image forming method as set forth in claim 16, wherein each of said plurality of picture image forming parts forms test patterns having the same width on said conveying means.

18. A picture image forming method as set forth in claim 16, wherein each of said plurality of picture image forming parts forms a plurality of test patterns having different width on said conveying means.

19. A picture image forming method for forming a picture image by superposing picture images on a recording medium using a plurality of picture image forming parts for forming said picture images in accordance with picture signals, said method comprising the steps of:

causing said plurality of picture image forming parts to form test patterns which are used for correcting the deviation in position of a corresponding one of said picture images formed by said plurality of picture image forming parts;

detecting the widths of said test patterns formed by said plurality of picture image forming parts;

determining each said detected width of said test pattern within a predetermined reference width range; and correcting the deviations in position of said corresponding said picture images, which have been formed by said plurality of picture image forming parts, on the detected results for said test patterns when said widths of said test patterns are within said predetermined reference width ranges, said plurality of picture image forming parts form test patterns on conveying means for conveying a recording medium to said plurality of picture image forming parts, and each of said plurality of picture image forming parts forms a plurality of test patterns having different width on said conveying means.

* * * * *